US009727025B1

(12) United States Patent
Rupert

(10) Patent No.: US 9,727,025 B1
(45) Date of Patent: Aug. 8, 2017

(54) CELESTIAL INSTRUMENT ADAPTED FOR USE AS A MEMORIAL OR SUN DIAL CLOCK

(71) Applicant: John G. Rupert, Mahtomedi, MN (US)

(72) Inventor: John G. Rupert, Mahtomedi, MN (US)

( * ) Notice: Subject to any disclaimer, the term of this patent is extended or adjusted under 35 U.S.C. 154(b) by 0 days.

(21) Appl. No.: 15/405,718

(22) Filed: Jan. 13, 2017

(51) Int. Cl.
*G04B 49/04* (2006.01)

(52) U.S. Cl.
CPC ..... *G04B 49/04* (2013.01)

(58) Field of Classification Search
CPC ..... G04B 49/02; G04B 49/04; G04B 19/24; G04B 19/262
USPC ..... 33/270, 271
See application file for complete search history.

(56) References Cited

U.S. PATENT DOCUMENTS

| | | | | |
|---|---|---|---|---|
| 849,475 A | | 4/1907 | Hewitt | |
| 1,146,412 A | | 7/1915 | Early | |
| 1,674,161 A | * | 6/1928 | De Bogory | G04B 49/02 33/270 |
| 2,192,750 A | | 3/1940 | Mead | |
| 3,099,881 A | | 8/1963 | Snider et al. | |
| 3,110,108 A | | 11/1963 | Sundblad | |
| 3,786,570 A | | 1/1974 | Davies | |
| 4,028,813 A | | 6/1977 | Eldridge | |
| 4,520,572 A | * | 6/1985 | Spilhaus | G04B 19/02 33/1 SA |
| 4,645,354 A | | 2/1987 | Mercer | |
| 4,945,644 A | * | 8/1990 | Fuller | G04B 49/04 33/269 |
| 6,009,628 A | * | 1/2000 | Mizushima | G04B 49/02 33/270 |
| 6,301,793 B1 | | 10/2001 | Gottesman et al. | |
| 6,604,290 B1 | * | 8/2003 | Hughes, Jr. | G04B 49/02 33/270 |
| 6,810,594 B2 | | 11/2004 | Lucarini et al. | |
| 6,871,407 B1 | | 3/2005 | Maegli | |
| 7,555,840 B2 | | 7/2009 | Chen | |
| 8,333,016 B1 | * | 12/2012 | Keele | G04B 49/02 33/270 |
| 8,528,218 B2 | | 9/2013 | Popendorf | |

(Continued)

OTHER PUBLICATIONS http://www.worldglobeu.com/product/SE-16SB, World Globe Universe product information for the Starship Earth II, 16 Celestial Sphere, Mar. 7, 2011, 6 pages.

(Continued)

*Primary Examiner* — Yaritza Guadalupe-McCall
(74) *Attorney, Agent, or Firm* — Thomas J. Nikolai; Nikolai & Mersereau, P.A.

(57) ABSTRACT

A celestial instrument as a memorial sun dial or star clock has a flat plate body or a spherical body that includes two hemispheres facing one another and spaced apart by a circular gap allowing sunlight to pass through the gap in the instrument. A planar date ring containing graphics surrounds the flat plate or the sphere. Upper and lower gnomons are rotatably secured to the plate or to the hemispheres. A stand includes a holder for a latitude arm that supports the gnomons. When the gap is placed in alignment with the ecliptic, sunlight can pass through a gap parallel to the plate or through a lens within the spherical body focusing a spot of light onto a display surface. A pointer on a rotatable shadow arm indicates the time on a 24-hour clock face.

27 Claims, 7 Drawing Sheets

(56) References Cited

U.S. PATENT DOCUMENTS

| | | | | |
|---|---|---|---|---|
| 2005/0155236 | A1* | 7/2005 | Andrewes | G04B 49/02 33/270 |
| 2010/0236083 | A1* | 9/2010 | Popendorf | G04B 49/02 33/270 |
| 2011/0061250 | A1* | 3/2011 | Andrewes | G04B 49/04 33/270 |
| 2013/0025141 | A1* | 1/2013 | Andrewes | G01C 21/02 33/270 |

OTHER PUBLICATIONS http://www.haddonstone.com/en-us/prod/pet-memorial-celestial-sundial-pedestal, Haddonstone product information for Pet Memorial Celestial Sundial & Pedestal, Feb. 6, 2017, 3 pages.

Parkin, Alastair, "An Ecliptic Demonstrator", Sky & Telescope, Apr., 1992, pp. 365-366, 2 pages.

* cited by examiner

CELESTIAL INSTRUMENT ADAPTED FOR USE AS A MEMORIAL OR SUN DIAL CLOCK

FIELD OF THE INVENTION

This invention relates generally to the field of sun dials celestial spheres and star clocks and to memorials or monuments and the like.

BACKGROUND OF THE INVENTION

Many solar instruments and sundials have been previously developed but none appear to the Applicant to be similar to the present invention. U.S. Pat. No. 3,110,108 describes a solar instrument having a base upon which is moveably mounted a main frame 6 that supports a ring 30 connected to a lower globe 69, an upper longitude disk 70 and an hour disk 71 located just beneath a strip or band 35 which is substantially different from the present invention. U.S. Pat. No. 2,192,750 describes a clock time sundial having a base 1 with a holder 2 moveably supporting a ring segment 3 which is connected to gnomon 7 comprising a taut wire. The remaining construction is also unlike that being claimed. U.S. Pat. No. 3,099,881 discloses a sun dial having a sun slot 3 which points south. An external pointer 6 points toward the slot 3. The sun shines through opposed slots 3 and 4 (FIG. 1) to indicate time only during the daytime using pointer 3 on a scale 5 that is on the sphere itself at right angles to the slots. No moveable shadow arm or lens was provided nor is there any suggestion for reflecting light onto an outer surface of a sphere or disk. This construction appears substantially different from the present Applicant's invention. U.S. Pat. No. 3,786,570 describes a sundial in which sunlight passes a translucent member 21 and is reflected from a planar surface 15 upwardly back toward the translucent member 21 which bears only slight similarity to the invention being claimed. U.S. Pat. No. 7,555,840 describes a device having a central lens 308but the remaining construction is substantially different from the Applicant's device. Other patents such as U.S. Pat. Nos. 4,028,813 and 4,520,572 describe sun interactive devices but their construction is not similar to the Applicant's invention. In the publication *Sky & Telescope* of Apr. 22, 1992, pages 365 and 366, Parkin describes an ecliptic disk supported by gnomons but there is no way suggested to find sidereal time nor a suggestion for directing a reflected or refracted light beam onto a display surface of any kind or onto a sphere or celestial disk.

SUMMARY OF THE INVENTION

This invention concerns a celestial instrument that is mounted during use in such a way that its polar spin axis is parallel to the earth's spin axis which presently points within about ½ of a degree from the north star. It can be used as a memorial or as a sun dial star clock.

The instrument has a celestial body that can be a spherical body or body that includes a flat celestial plate. The spherical body or sphere is most preferably constructed so that it contains a circular air gap that can enclose a lens in the form of a cylinder of transparent optical material in an ecliptic plane of the sphere which is inclined at about 23.5 degrees to the polar spin axis. When the sphere is rotated about its polar spin axis, its ecliptic plane can be placed parallel to the ecliptic plane of the earth on that day and at that time, i.e. the plane in which the earth travels around the sun. In this orientation, the light from the sun can pass through the gap onto a surface of a shadow arm to produce a spot of light and with a lens present the light can be focused into a brighter spot by the lens.

A date ring having a gauge or scale consisting of demarcations engraved or printed thereon is also positioned in the ecliptic plane of the sphere just under the beam of sunlight which passes through the gap when the ecliptic planes are lined up. In this way the bright spot of light is focused on the shadow arm directly above the day of the year printed on the date scale of the date ring. When the celestial body is a flat plate rather than a sphere, it can be centered within the date ring so that it is circumscribed by the date ring.

A curved shadow arm is mounted to partially encircle the celestial disk or sphere and to pivot around its axis. When the shadow arm is centered on the shadow of the gnomon or rotated manually to where the bright spot is focused, a pointer on the shadow arm tells the time on a 24 hour clock. The inner surface of the shadow arm is preferably coated with a reflective material that also refracts light, e.g., a diffraction grating which reflects the bright focused spot back onto the sphere as a brilliant rainbow colored area on the sphere above the date shown on the date ring.

The celestial body can be marked on its outer surface with a combination of stars from well known constellations and also custom stars named for a person's descendants and ancestors at a location on the sphere at an ecliptic longitude corresponding to the birthday of that person. The person's names and their stars are lighted by the rainbow of color reflected from the shadow arm on their birthday.

The sphere is constructed so that when its ecliptic plane is lined up with that of the sun, the stars printed or engraved on the surface of the sphere are also lined up with the stars in the sky even though they cannot be seen during the day.

A star dial at the top of the sphere is provided parallel to equatorial plane of the celestial sphere, i.e., the same as the plane of the earth's equator to allow a person to line up the stars marked on the sphere with the stars in the sky at night by rotating the sphere. When the stars are lined up in this way the shadow arm can be rotated to the date on the date ring. Its pointer will then tell the time at night on the 24 hour clock.

When the celestial body is a sphere rather than a flat celestial plate, on the lower hemisphere of the sphere, cylindrical surfaces can be provided by cutting away materials which allow photographs to be mounted or anodized directly into the sphere. These photos further serve to commemorate the memories that a person being memorialized shares with his ancestors and descendants.

The inside of the celestial sphere is hollowed out to provide upper and lower sealed cavities suitable for use as an urn or to contain other memorabilia like memory sticks, DNA samples, etc.

A sealed cap and coupling for an interior flash drive can be provided on the surface of the sphere to provide easy access to detailed memories and ancestral information for people and events whose stars are reflected on the surface of the sphere.

It will thus be seen that the invention, a blend of art and science, can be used to commemorate a person's accomplishments in life and memories of his/her parents, children, grandchildren, and ancestors. The memories are captured metaphorically as stars on the surface of the celestial sphere which might include not just well-known constellations, but also stars that are named for the person's parents, descendants, and ancestors. Further, the sphere almost magically lights each of the names of one or more person's named stars with a rainbow of colored light on their birthday. It can also contain pictures which capture a person's accomplishments and memories with the children and grandchildren. These pictures can be permanently etched or anodized into the sphere. The sealed internal cavities can be used as urns or for special items like memory sticks, DNA samples, or other treasured heirlooms. As a memorial, the invention is designed to sit inside in a sunlit room or in a relative's, e.g., a granddaughter's garden or as monument in a columbarium or cemetery. The memorial also tells the time of day and the date using light from the sun and the time of night using the stars.

In addition to serving as a memorial for an individual, it may serve as a memorial or monument for an organization to commemorate its previously directors or major milestones. It could also commemorate the members and victories of a successful sporting team. It could also be used at a college or science museum to commemorate the academic giants like Newton, Galileo, Kepler, and Copernicus for field of Astronomy. Above Newton's tomb in Westminster Abbey, there is a quote "I walked on the shoulders of giants". We all do and the inventor would like to make a memorial in their honor.

In addition to providing stars to metaphorically commemorate a person's loved ones, the star dial provides the user or observer an introduction to astronomy. It also provides a very graphic representation of the geometries of the ecliptic and equatorial planes, the earth's spin axis, and even its precession. It shows us the precise direction we are travelling at about 67,000 mph through space in our journey around the sun and because it does not feel like we are travelling at 67,000 mph, a little introduction to relativity. The dial also shows you where the sun is at night even though it cannot be seen. It also shows where and when the sun will rise and set. In the spirit of relativity, the invention precisely reflects a view of the stars and sun as seen by a person sitting on top of the world—namely the observer and perhaps the interned person. The user of the invention could entertain a discussion of optics and diffraction gratings, rainbows in the sky and the rainbows that are produced on the surface of water caused by a film of spilled oil or gasoline. The present inventor is looking forward to sharing these insights with his grandchildren in the setting of this memorial.

These and other more detailed and specific objects and advantages of the present invention will be better understood by reference to the following figures and detailed description which illustrate by way of example but a few of the various forms of the invention within the scope of the appended claims.

All citations listed herein are incorporated herein by reference as fully and completely as if reproduced herein in their entirety and specifically indicated to be incorporated.

BRIEF DESCRIPTION OF THE DRAWINGS

The numbers in the drawings are such that like numbers are consistently used to describe like parts throughout the several drawings and in the detailed description of the invention which follows.

DETAILED DESCRIPTION

Figure 1:
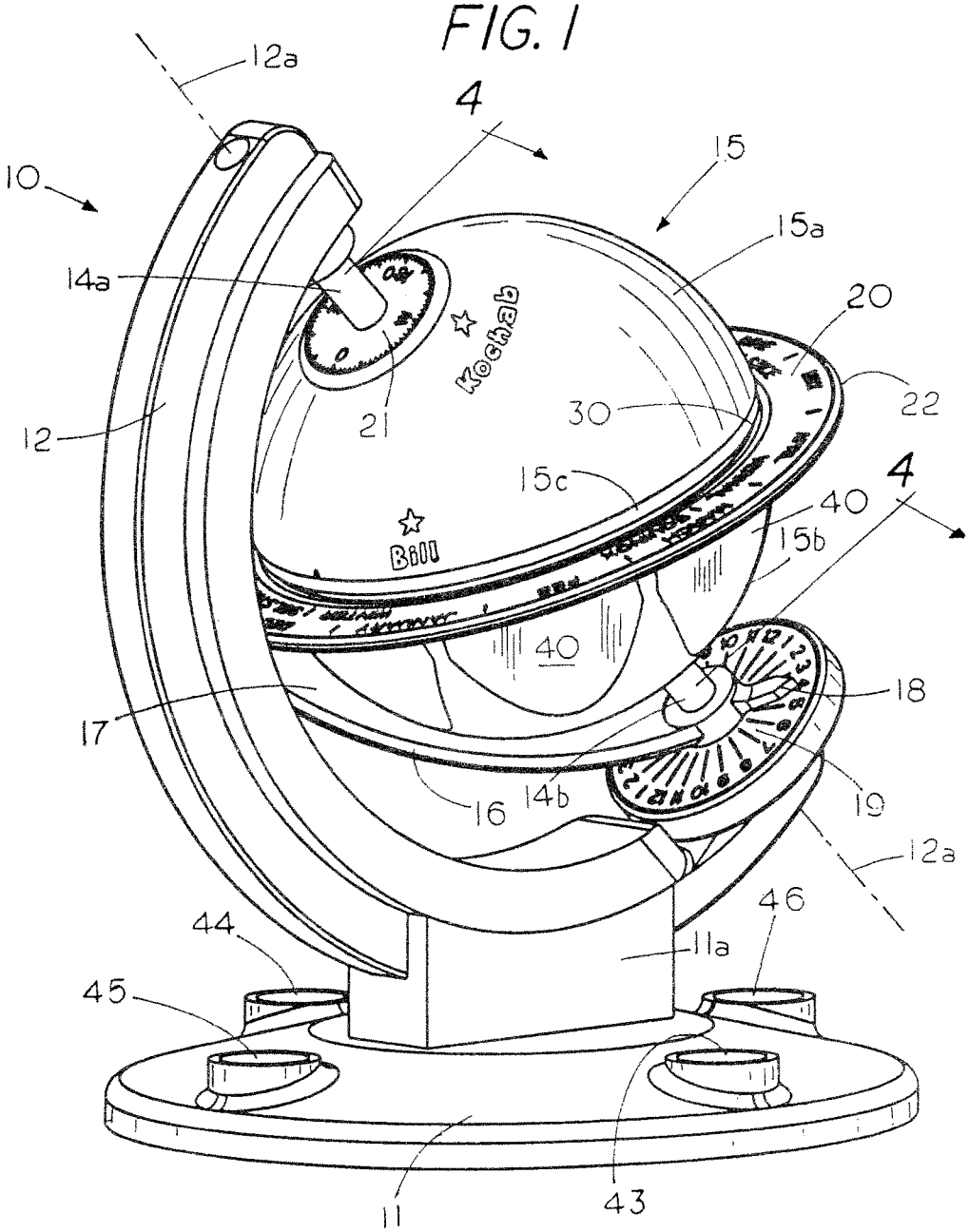
FIG. 1 is a perspective view of the invention.
Figure 2:
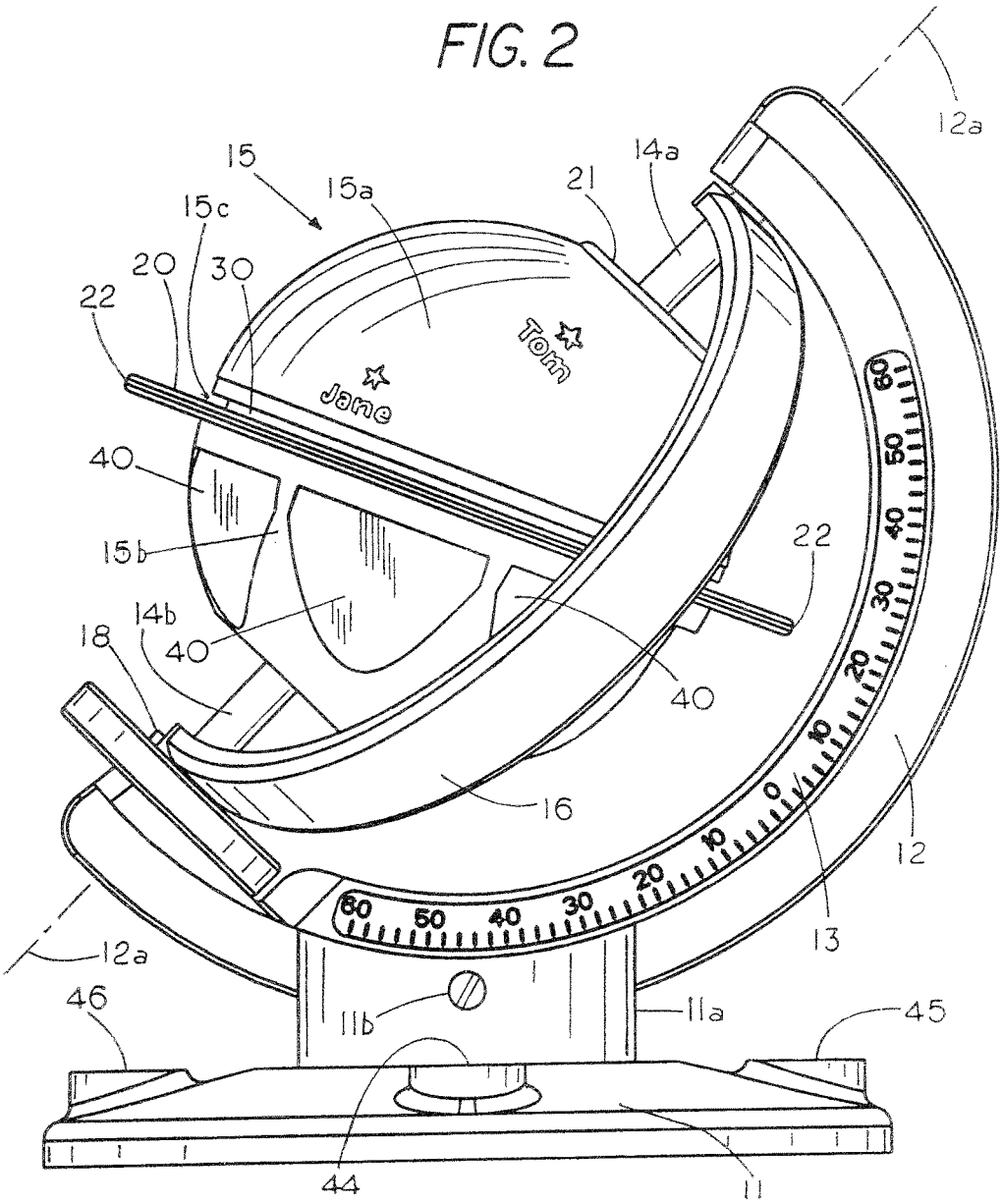
FIG. 2 is a side elevational view of the invention showing the opposite side shown in FIG. 1.
Figure 3:
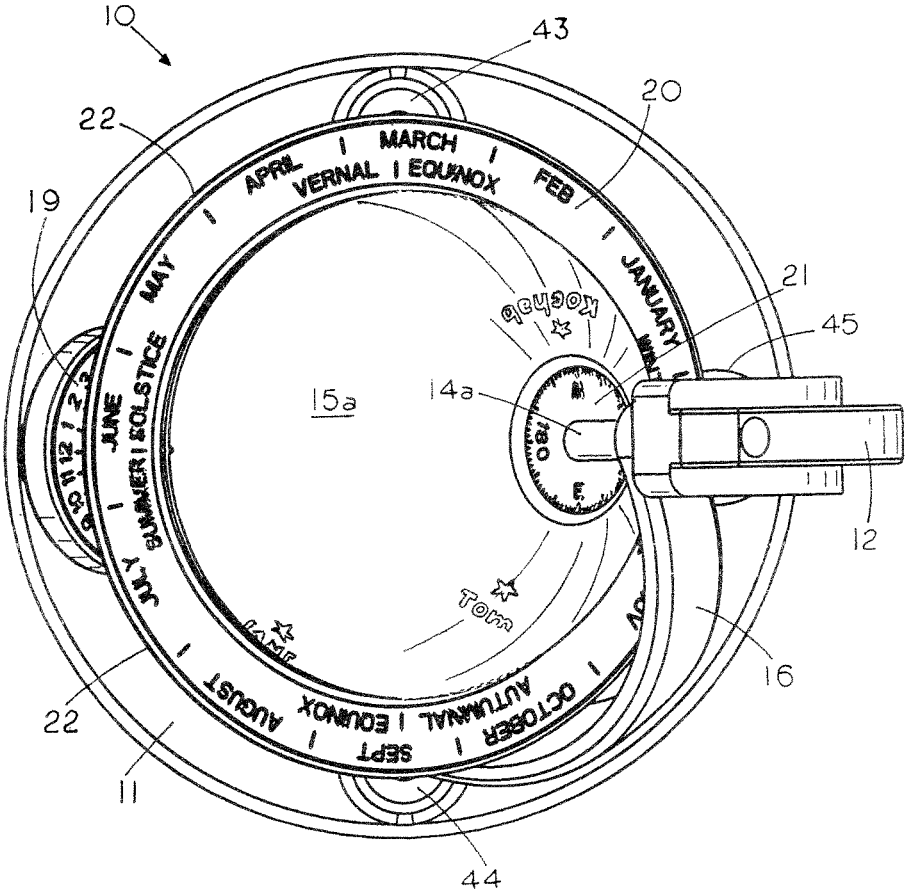
FIG. 3 is a top view of the invention.

Refer now to FIGS. 1-3 which illustrate one embodiment 10 of the invention in which a celestial body comprises a celestial sphere 15 having opposed upper and lower opaque light-blocking hemispherical hubs or hemispheres 15*a* and 15*b* respectively separated by a circular air gap 15*c* that is inclined with respect to a polar spin axis 12*a* so as to form a single transverse passage between the hemispheres that allows sunlight to pass entirely through the celestial sphere 15 from any side thereof. The gap 15*c* is typically about 1/16 to 1/8 inch in height. A planar date ring 22 aligned with the gap 15*c* of the sphere 15 carries visible graphics 20. Upper and lower coaxial gnomons 14*a* and 14*b* define the polar spin axis 12*a* between the poles of the rotatable celestial sphere 15 and are secured at their upper and lower ends to a curved latitude arm 12 which is, in turn, slidably supported in a holder 11*a* of a stand 11 that serves as a base for the device. A transparent optical element or lens, e.g., a cylindrical glass lens 30 is secured between the hemisphere so that the entire sphere assembly 15*a*, 15*b*, 22 and 30 rotates together as a unit. The cylindrical side wall of lens 30 is aligned within the gap 15*c* (FIG. 4) making it possible to focus sunlight (FIG. 5) passing through the gap 15*c* onto a curved shadow arm 16 that is in turn pivotally secured at each end to one of the gnomons in a position partially encircling the sphere 15 and located between the sphere 15 and the latitude arm 12. The circular gap 15*c* located between the poles of the spherical body is in the ecliptic plane of the celestial sphere 15 so as to provide a passage that allows light to pass through the spherical body of the instrument.

The stand 11 which functions as a base supports the invention on a horizontal surface such as a table, a pedestal or the ground. The stand supports the latitude arm 12 in such a way that the polar axis 12*a* can be aligned with the spin axis of the earth. During use, sidereal positioning is achieved by pointing the polar axis 12*a* very closely to the North Star. This is most easily accomplished in two steps. First, the stand must be leveled and pointed so that indicators north 45, south 46, east 44, and west 43 are aligned with true north, south, east, and west of the earth. Second, the latitude arm 12 must be mounted at the proper angle corresponding to the latitude of the site shown on a latitude graphic scale 13. In this way, the proper elevation of the spin axis 12*a* which is aligned with that of the gnomons 14 is achieved and is equal to the latitude of the memorial site. A means for securely attaching the holder 11*a* of the stand to the latitude arm such as a set screw 11*b* provided in a holder 11 is shown in FIG. 2.

The latitude arm 12 supports and aligns the gnomons which in turn support the celestial sphere 15. A pair of threaded stainless steel rods can be used to form the gnomons 14*a* and 14*b* to allow easy assembly and removal of the celestial sphere. These threaded rods are preferably shrouded with anodized aluminum tubing (not shown) for appearance. It is important to note that there are two spaced apart gnomons.

Figure 4:
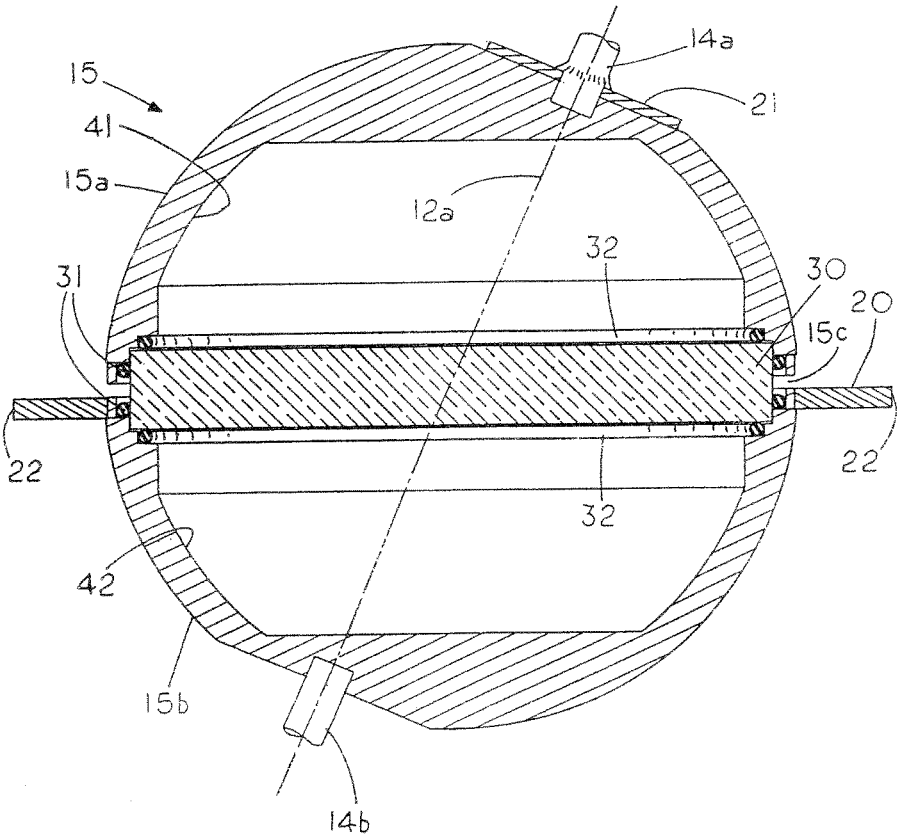
FIG. 4 is a cross-sectional view taken on line 4-4 of FIG. 1.
Figure 5:
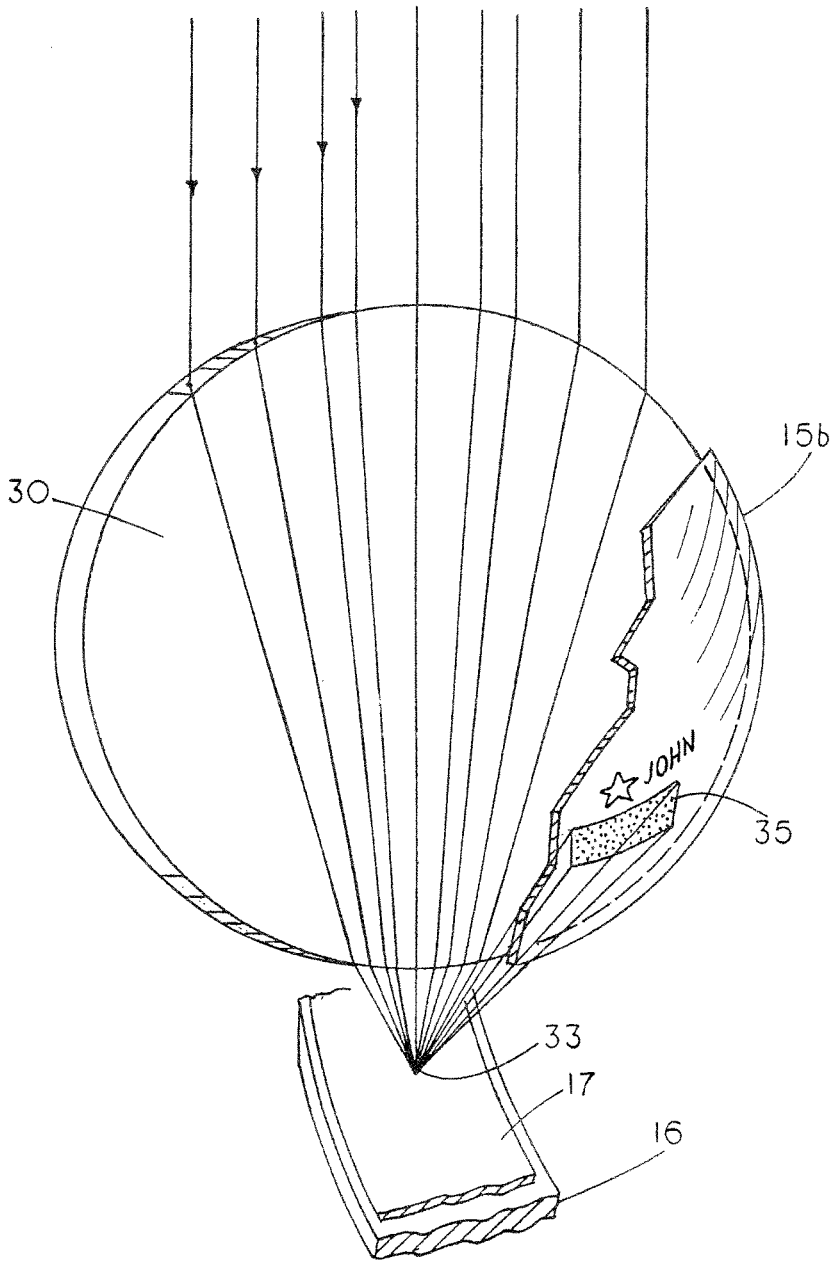
FIG. 5 is an optical diagram showing a beam of sunlight passing through a lens used in the invention.

The shadow of the gnomons is used to tell the time when the shadow arm 16 is manually aligned with the shadow. The shadow arm 16 serves several functions. First, it can be aligned with the shadows of the gnomons 14*a* and 14*b* or with a bright focused spot of light created by a transparent optical lens 30. In this example, a glass lens 30 having a sidewall of cylindrical shape and flat parallel upper and lower surfaces is illustrated in FIGS. 4 and 5. The shadow arm 16 has a pointer 18 which tells the time of day on a 24-hour clock dial face 19 fixed to latitude arm 12 when dial face 19 is properly aligned as indicated above. At night, when the stars on the celestial sphere of the universe are properly aligned with star positions located on the sphere 15 as will be discussed below, the shadow arm 16 can be placed on the date shown by the date ring graphics 20. Its pointer 18 will then tell the time at night. The inner surface of the shadow arm is most preferably lined with reflective material 17 that is also preferably refractive as for example a diffraction grating 17 which is able to reflect a rainbow or multiple rainbows onto people's names and stars engraved or printed on the surface of the display sphere on a given date such as the birthday of the person named. The diameter of the reflective material relative to the sphere 15 is determined by the focal length of the lens 30 as discussed in more detail below.

The 24 hour clock dial 19 is rigidly attached to the latitude arm. The star dial 21 is attached rigidly to gnomon 14*a* and to latitude arm 12 while the sphere 15 is free to be rotated on the gnomons. The star dial 21 provides a means to align the celestial sphere 15 with the stars at night when they are visible. For example, the invention can make use of the bright star, Kochab (FIG. 1), which is in the Ursa Minor constellation. It is selected because of it high declination of 74.1 degrees. It is close to the North Star and visible all night long from most northern latitudes. By using a device like a goniometer which measures angles, it is possible to accurately measure the rotation angle of the star Kochab in the equatorial plane which is parallel to the plane in which the star dial 21 is oriented. Once this is done, the sphere 15 can be rotated to orient Kochab at the measured angle and thus line up all of the stars that are marked on the surface of the sphere 15 with corresponding stars in the sky. When the stars marked on the surface of the instrument 10 are lined up in this way with those in the heavens the shadow arm can be rotated anywhere throughout a 360° circle to place it in alignment with the location of the current date on the date ring 22. Its pointer 18 will then tell the time at night on the 24-hour clock 19. In the southern hemisphere, there is no pole star but the angle between any two bright stars in the constellation Octans such as nu and delta can be used to position the celestial body 15 or 34 in alignment with the stars in the sky.

The date ring 22 is affixed to sphere 15 at its ecliptic to support the date disk graphics 20. During use, the flat plane of the date disk is parallel to the ecliptic plane of the solar system. The diameter of the date ring is determined by the diameter of the cylindrical lens body 30 and by the refractive index of the glass. For low iron glass, the date disk diameter is nominally slightly less than a minimum clearance driven by manufacturing and assembly, for example, it will be 1.42 times the diameter of the glass lens 30. When the gap 15*c* is aligned with the ecliptic, sunlight passing through lens body 30 will produce a brightly focused spot of light next to the date marked on the date ring 22. The inner surface of the shadow arm 16 is located at a distance from lens 30 equal to the focal diameter of the lens 30. There is an acceptable margin of variation in the focal point since the cylindrical focus is not as precise as with a typical parabolic magnifying glass.

There is a known equation of time which results in a variation of solar time from clock time of about +/−15 minutes that is caused by the eccentricity of the earth's orbit and the slight nutation of the earth biannually. Many sun dials provide correction for this anomaly on a graph. If desired a known equivalent "equation of date" will produce a date variation of about plus or minus 3 days from the linear read-out offered by the date graphics 20. In addition to the date, other graphics can be added to the graphics 20 such as the equinoxes and solstices. Many further graphics can be included such as dates for the various Zodiac constellations and other lore developed over thousands of years by different cultures in different locations around the world.

If desired timelines can be placed along the date disk 19 associated with the 26,000 year period for the precession of the earth. Key historic figures as well as outstanding religious, individuals, scientists or scientific events can be included over the last 10,000 years for example. Provisions for altering the spin axis 12*a* relative to the stars can also be made to account for the precession of the earth. A difficulty here is that over this time frame involved, the stars of the well-known constellations will have significantly different locations as well. Changing those features are beyond the scope of this invention at this time. The star clock should perform well for at least two hundred years. The day time clock should function well indefinitely as long as we continue to adjust our days/calendars so that the vernal equinox occurs on March 21 and religious events like Christmas continue to occur in the winter on December $25^{th}$.

The glass disk lens 30 is best discussed with reference to FIGS. 4 and 5. As noted previously, when the celestial sphere 15 is properly aligned so that its ecliptic plane and gap 15*c* is parallel to the ecliptic plane of the earth, light can shine through the disk lens 30 so as to focus a bright spot of light 33 on the inner surface of the shadow arm 16 as well as reflect a rainbow of colored light 35 onto the names and stars or of the persons engraved or marked on the outward display surface of the celestial sphere body 15 (FIG. 5). FIG. 4 shows how two O-rings 31 support the glass lens radially and two O-rings 32 support the glass axially. These 0 rings serve three functions. First they provide a seal for the upper and lower inner cavities 41 and 42 (FIG. 4) which may contain ashes or memorabilia. Second, they provide for differences in thermal expansion between the glass and the aluminum celestial sphere. Third, they provide shock protection for the glass in case the memorial is impacted in some way like a severe hail storm or a falling branch. The mounting of lens 30 also holds the hemispheres together as a rigid member while providing a clear 360 degree light path free from any structural obstruction that would degrade the optics or the light image.

The planar date ring 22, which is also parallel to the ecliptic plane, sits just under the beam of light coming through the lens 30 from the sun. In fact the converging rays approaching the focal point can light up the date like an arrow if the date ring graphics 20 are slightly elevated into the light beam. The focal spot of light falls directly on the inner surface of the shadow arm which is right next to the edge of the date disk. With a mirror-like reflective diffraction grating 17 on the inner surface of the shadow arm 16, the spot produced by the sun is blindingly brilliant.

The inner surface of the shadow arm 16 can be polished or covered with the reflective material 17 which can also be refractive such as a diffraction grating film 17 or a holographic film such as 0.002 inch thick holographic rainbow film made by Transilwrap Co. Inc. of Franklin Park, Ill., which reflects the focused light from the lens back on to the names and stars located on the celestial sphere. In addition, depending on the design and orientation of the reflector 17, multiple rainbows can be created which are nominally vertical or horizontal and which can also reflect light so as to strike the shadow arm both above and below the +/−23.5 degree region where the focused light occurs over the course of the year. Protection of the reflector can be provided by a standard auto body clear coat even though that may require occasional maintenance. In a typical example, a rainbow of colored light is produced on the surface near the graphic demarcation on the sphere 15 (FIG. 5) which indicates the birthday of a relative such as a grandchild.

Cylindrical picture surfaces 40 are illustrated in the side view FIGS. 1 and 2. If desired, the pictures 40 can be placed on a circular frustoconical surface segment replacing a circular portion of the surface of the sphere. Four such conical frustum segments could display a sporting team of 30 members. These pictures add color and meaning to the memorial for both the interned and his or her descendants and their shared memories.

Sealed receptacles 41 and 42 are best illustrated in FIG. 4 which shows that the hemispheres are hollow. These two large receptacles can serve as an urn for one or more people. It is a beautiful thought to have one's ashes placed in the garden of a relative such as one's granddaughter in the sun and under the night sky.

Figure 6:
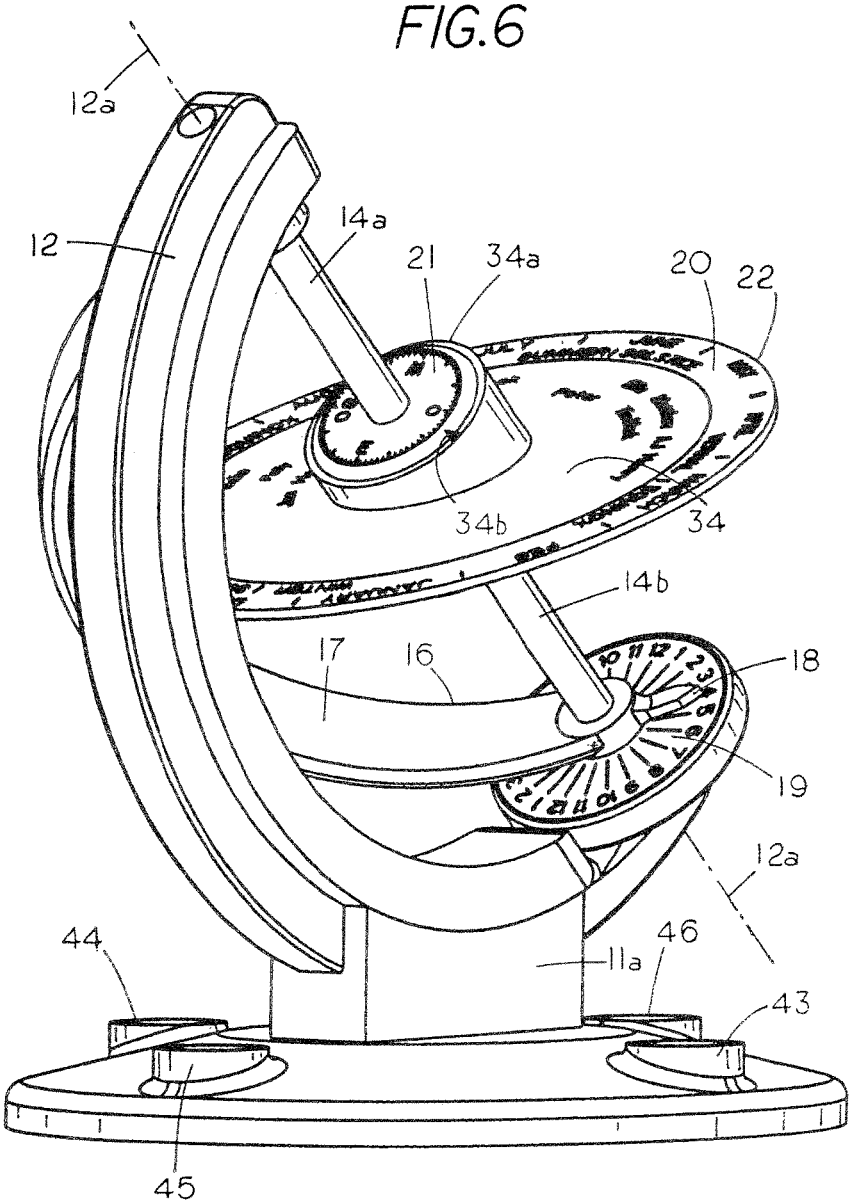
FIG. 6 is a perspective view similar to FIG. 1 except that the celestial body is a flat celestial plate rather than a celestial sphere.
Figure 7:
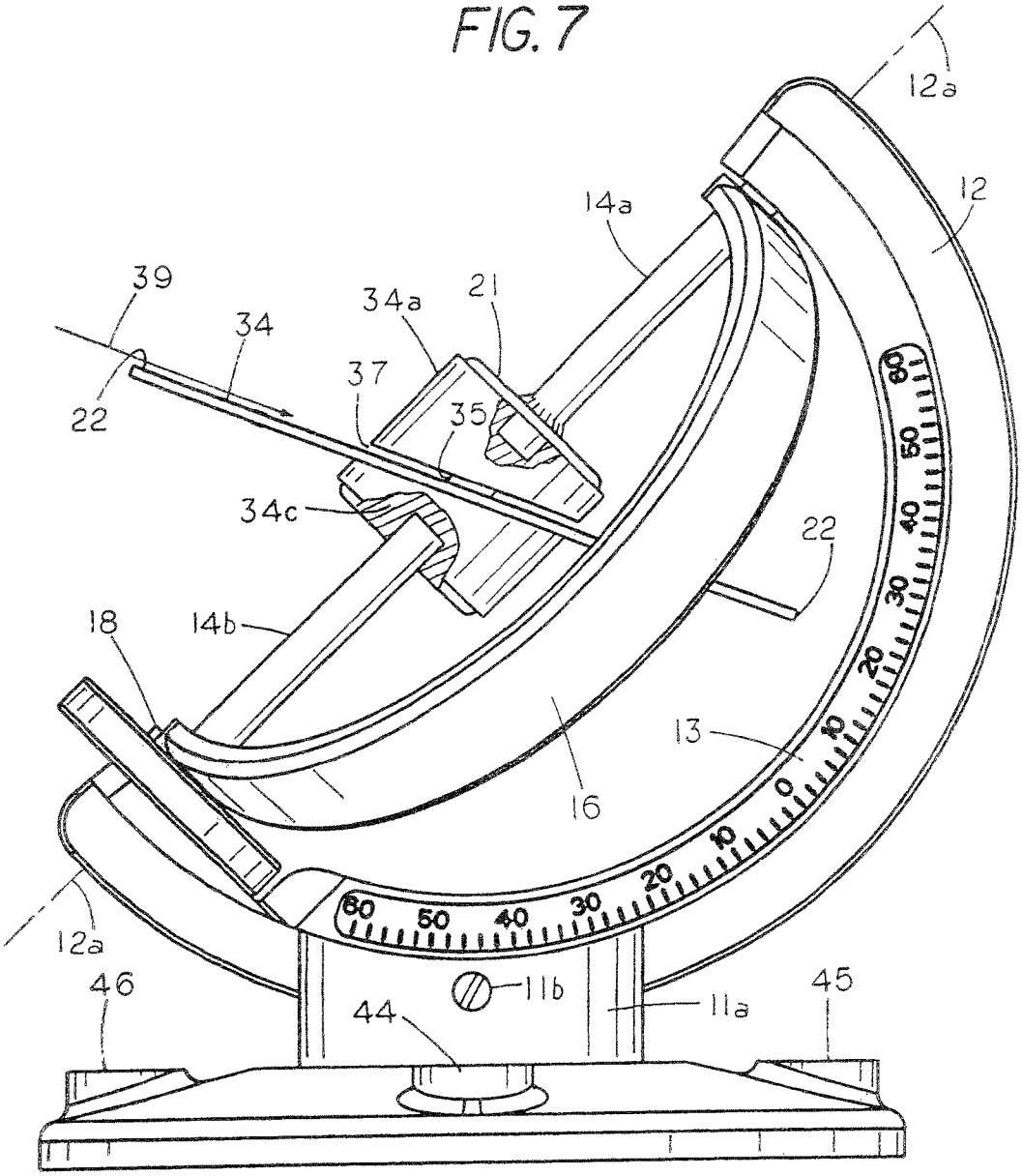
FIG. 7 is an elevational view of FIG. 6 as seen from the opposite side.

Refer now to FIGS. 6 and 7. Here the upper and lower hubs are numbered 34*a* and 34*c*. Instead of the hubs forming a sphere as in FIGS. 1-5, a flat celestial plate 34 is centered within the date ring 22 coplanar therewith so as to be circumscribed by the date ring. It is convenient to make plate 34 from the same sheet of metal as ring 22 and to place graphic markings as shown at selected locations on its upper and lower display surfaces. Markings can designate the position of stars or constellations and the location of spots of reflected sunlight on the birthday of individuals related to an interned person.

As in FIGS. 1-5 a star dial 21 is rigidly connected at right angles to the upper gnomon 14*a* which is in turn rigidly attached to the latitude arm 12. The lower hub 34*c* is fastened rigidly to the flat celestial plate 34. The upper hub 34*a* is fastened rigidly to the lower hub 34*c* by a coupling link 35 in such a way as to form an air gap 37 (FIG. 7) between the flat celestial plate 34 and bottom surface of the upper hub 34*a*. The rigid assembly of the upper and lower hubs 34*a* and 34*c* and the flat celestial plate 34 and date ring 22 is free to rotate about the gnomons for alignment of the celestial plate 34 with the ecliptic plane. A graphic marking or pointer 34*b* to denote the position of a star such as Kochab that is close to the pole star, is placed on the supper surface of the upper hub 34*a* for alignment of the stars at night with the stars marked on plate 34 by means of the star dial 21. During use sunlight rays 39 (FIG. 7) pass over the surface of the date ring 22 and the celestial plate 34 then through the gap 37 and onto the shadow arm 16. The gap 37 between hub 34*a* and plate 34 is devised to accurately position a spot or line of light on the shadow arm 16.

The celestial plate 34 and date ring 22 of FIGS. 6 and 7 is rotated during use so that it is aligned with the ecliptic plane of the solar system. Sunlight rays 39 are blocked by the hub 34*a* but pass through gap 37 to the shadow arm 16 without being focused so as to provide a precisely located line of light on arm 16 with the shadow of connecting link 35 at its center. The embodiment of FIGS. 6 and 7 have several advantages including significantly less cost because the graphics for the names and stars on the disc can more easily etched with a laser cutter for a fraction of the cost of engraving graphics onto a sphere. In addition, without the lens 30, the memorial is easier to maintain and is less susceptible to damage.

A single star marker or pointer on the upper gnomon can be used to designate the longitude, for example, of the star Kochab as noted above to line up the celestial disk 34 with the stars in the sky. The disk 34 can include prominent stars as well as well-known constellations projected onto the disk in addition to memorial stars and the names of individual people such as relatives of the deceased.

A rainbow will also be reflected back onto the disk 34 by the holographic film or other reflective and refractive surface on the inside of the shadow arm, albeit this rainbow is not as intense as the rainbow colors obtained from the focused spot of light produced by the glass lens described in FIGS. 1-5.

The width of the gaps 15*c* and 37 for either of the embodiments affects the accuracy of the location of the resulting light spot. The thinner the gap, the more accurate but the less light that is able to pass through the gap. Thus, there is a tradeoff.

Many variations can be made within the scope of the appended claims. For example, if desired the hemispherical design can be constructed with a servo motor contained in each of the upper and lower receptacles 41. The servo motors can be driven by a time function and also, if desired, can be automated with photocells. The servo motors can also be powered, if desired, with a solar panel.

Many variations of the invention within the scope of the foregoing specification will apparent to those skilled in the art once the principles described herein are read and understood.

The invention claimed is:

1. A celestial instrument adapted for use as a sunlight displaying, reflecting or focusing device comprising:

a celestial body adapted to have graphic markings positioned at chosen locations thereon that are selected from the group consisting of names of persons, the names of stars and the names of constellations, the celestial body having a polar spin axis at its center, a holder supporting the celestial body for rotation on the polar spin axis and the holder supporting the spin axis for movement enabling the spin axis to be tilted to a selected angle of azimuth and elevation so that the spin axis 12*a* is aligned parallel to the axis of the earth, the celestial body including a date ring that designates the months of the year circumferentially thereon, a central display surface as a part of the celestial body that is printed or engraved with the graphic markings and the display surface being circumscribed by the date ring, the date ring and the display surface being adapted to be aligned with the ecliptic and the date ring being inclined about 23.5 degrees to the polar spin axis of the instrument, an opaque light-blocking hub rotatably mounted on the polar spin axis of the date ring and the display surface, the hub having an inward end that is spaced from a plane of the date ring to define a gap therebetween through which sunlight can pass when the date ring is parallel to the ecliptic plane of the earth and a reflector as a part of the instrument positioned to reflect sunlight that has passed through the gap back onto the display surface of the celestial body when the date ring is aligned with the ecliptic plane of the earth.

2. The celestial instrument of claim 1 wherein the reflector comprises a surface of a curved shadow arm pivotally mounted on the instrument to at least partially encircling the celestial body.

3. The instrument of claim 1 including a refractor supported as a part of the instrument in the path of the sunlight so as to project sunlight onto a surface of the celestial body in one or more rainbow colors.

4. The instrument of claim 2 wherein the shadow arm has a pointer for pointing at demarcations on an hour gauge supported as a part of the instrument.

5. The instrument of claim 1 wherein a curved latitude arm that at least partially encircles the celestial body is movably secured to the holder for supporting the celestial body on the spin axis thereof by upper and lower coaxial gnomons that are fixed to the latitude arm and each gnomon has a gauge plate secured thereto with graphic markings thereon.

6. The celestial instrument of claim 1 wherein the central display surface is a substantially flat plate concentric within the date ring and the graphic markings are located thereon.

7. The celestial instrument of claim 1 wherein the central display surface is a hub comprising at least one celestial hemisphere that is coaxial with the date ring and graphic markings are located on an outward surface of the hemisphere.

8. A celestial sphere instrument adapted for use as a memorial comprising, a spherical body having a central polar axis and including opposed upper and lower hemispheres facing one another in axial alignment so as to assume a spherical form and being spaced apart from one another by a circular gap located in an ecliptic plane of the spherical body so as to provide a passage that allows sunlight to pass entirely through the spherical body when the ecliptic plane of the sphere is parallel to the ecliptic plane of the earth, a date ring on the spherical body positioned proximate the plane of the circular gap and being marked with visible graphics, a pair of axially spaced apart axially aligned gnomons wherein each of the gnomons is rotatably secured to one of hemisphere and extends outwardly therefrom along the polar spin axis of the spherical body such that the gnomons are inclined with respect to the plane of the circular gap between the hemispheres, a stand that is adapted to be mounted on a support such as a horizontal surface of a table, a platform or the ground, the stand acting as a base for the spherical body, the stand includes a holder for a latitude arm that has spaced portions to which outward ends of the gnomons are mounted, the latitude arm being positioned to at least partially encircle the spherical body and support the gnomons, such that the gnomons are aligned with the spin axis of the earth.

9. The instrument of claim 8 including a curved shadow arm supported to at least partially encircle the spherical body, the shadow arm having a reflective surface adapted to reflect light passing through the spherical body back onto a display surface of the spherical body.

10. The instrument of claim 9 wherein the reflective surface is a diffraction grating or holographic sheet positioned on the shadow arm facing the spherical body.

11. The instrument of claim 8 wherein at least one of the hemispheres is made hollow for being used as a receptacle.

12. The instrument of claim 8 wherein a transparent optical body is mounted in the plane of the gap.

13. The instrument of claim 12 wherein the transparent optical body is a cylinder mounted within the spherical body that has a circular sidewall which is aligned within the gap between the hemispheres to thereby focus light passing through the gap.

14. The instrument of claim 8 wherein the latitude arm is slidably mounted on the holder for aligning the plane of the gap and the date ring with the ecliptic of the earth.

15. The instrument of claim 8 wherein there are provided on the outer surface of the spherical body at least one of a) graphic representations of stars positioned to be aligned with corresponding stars in the sky, b) the names of persons and c) the names of companies or organizations.

16. The instrument of claim 8 wherein a pointer on a shadow arm that is pivotally mounted on the gnomons is positioned for pointing to a circular date disk affixed to the latitude arm.

17. The instrument of claim 15 wherein a star dial is located on the spherical body proximate one of the gnomons for aligning the stars marked on the spherical body with the stars in the night sky.

18. A celestial sphere instrument adapted for use as a memorial comprising, a spherical body having a central polar axis and including a pair of opposed upper and lower hemispheres facing one another in axial alignment so as to assume a spherical form and being spaced apart from one another by a circular gap located between poles of the spherical body when positioned in the ecliptic plane of the celestial sphere provides a passage that allows light to pass entirely through the spherical body, a date ring on the spherical body positioned proximate the plane of the circular gap for being marked with visible graphics, a pair of axially spaced apart axially aligned gnomons wherein one of the gnomons is rotatably secured to each hemisphere and extends outwardly therefrom along the polar spin axis of the spherical body and the gnomons are inclined with respect to the plane of the circular gap between the hemispheres, a stand that is adapted to be mounted on a support such as a horizontal surface of a table, a platform or the ground to act as a base for the spherical body, the stand includes a holder for a latitude arm to which gnomons are fastened such that the latitude arm at least partially encircles the spherical body and supports the gnomons, the spherical body and the date ring, a star dial fastened to one of the gnomons for aligning the stars in the sky with a star graphic on the sphere such that when a shadow arm is centered on the current date on the date ring a pointer on the shadow arm then tells the time on a 24-hour clock face, and the stand has at least one graphic marking for aligning the stand with the poles of the earth.

19. The instrument of claim 18 having a curved shadow arm that at least partially encircles the spherical body and has a reflective surface adapted to reflect the spot of light back onto the spherical body.

20. The instrument of claim 19 wherein the reflective surface is a refractive diffraction grating or holographic sheet.

21. The instrument of claim 18 wherein at least one of the hemispheres is made hollow for being used as a receptacle.

22. The instrument of claim 18 wherein the pointer on the shadow arm indicates the time of day or night on the 24-hour clock face when, during the day, the shadow arm is aligned with the shadow of the gnomons or when, during the night, the shadow arm is placed on the current date displayed on the date ring and the stars on the sphere are aligned with the stars at night by means of the star dial.

23. The instrument of claim 18 wherein the latitude arm is slidably mounted on the holder for aligning the plane of the gap and the date ring with the ecliptic of the earth.

24. The instrument of claim 18 wherein there are provided on the outer surface of the spherical body at least one of marking a) a graphic representation of one or more stars positioned to be aligned with corresponding stars in the sky, b) the name of a person and c) the name of a business or social organization.

25. The instrument of claim 18 wherein a pointer on a shadow arm that is pivotally mounted on the gnomons is positioned for pointing to an hour dial on the latitude arm.

26. The instrument of claim 18 wherein a lens is held in place within the sphere by compliant material.

27. The instrument of claim 18 wherein a photograph is applied to an outer cylindrical or frustoconical surface area of the spherical body.

* * * * *